US006628080B1

(12) United States Patent
McCullough et al.

(10) Patent No.: US 6,628,080 B1
(45) Date of Patent: Sep. 30, 2003

(54) SPRING CLIP FOR LAMP WITH SHROUD

(75) Inventors: Ebon L. McCullough, New Ipswich, NH (US); David J. Lamprey, Jr., Bow, NH (US)

(73) Assignee: Osram Sylvania Inc., Danvers, MA (US)

( * ) Notice: Subject to any disclaimer, the term of this patent is extended or adjusted under 35 U.S.C. 154(b) by 8 days.

(21) Appl. No.: 10/128,866

(22) Filed: Apr. 24, 2002

(51) Int. Cl.[7] ..... H01J 13/46; A47B 91/00

(52) U.S. Cl. ..... 315/56; 315/363; 248/346.06; 248/346.03; 248/594

(58) Field of Search ..... 315/56, 57, 58, 315/363; 248/594, 617, 630, 628, 629, 346.04, 346.03

(56) References Cited

U.S. PATENT DOCUMENTS 4,938,440 A * 7/1990 Weinfield ..... 248/183.1

5,934,019 A * 8/1999 Rotharmel et al. ..... 49/28

* cited by examiner

*Primary Examiner*—Don Wong
*Assistant Examiner*—Tuyet T. Vo
(74) *Attorney, Agent, or Firm*—WIlliam E. Meyer

(57) ABSTRACT

A spring clip 10 for assembling a light source to a shroud comprises a base 12 extending in a first plane and having an aperture 14 centrally located therein. Aperture 14 is substantially circular and is provided with cutouts 14*a* to provide flexibility. Upstanding walls 16, 18, are provide, one at each end of the base 12. A first lip 20 extends orthogonally away from the wall 16 in a second plane and a second lip 22 extends orthogonally away from the wall 18, also in the second plane. The second plane is substantially parallel to the first plane but spaced therefrom. Flags 24, 26 are formed, respectively, with the lips 20, 22, the flags extending away from the lips in a plane transverse to the first and second planes. Extended ends of a light source are accommodated into the apertures 14 and the lips and walls of the clips frictionally engage an interior surface of a shroud.

1 Claim, 2 Drawing Sheets

SPRING CLIP FOR LAMP WITH SHROUD

TECHNICAL FIELD

This invention relates to lamps and particularly to arc discharge lamps. Still more particularly, the invention relates to arc discharge lamps employing a ceramic arc tube, a shield and mounting means for mounting said arc tube within the shield.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. Recent advances in the art have employed a ceramic arc tube constructed, for example, from polycrystalline alumina. It is with the latter type that this invention is particularly concerned. The arc tube, itself hermetically sealed, has tungsten electrodes sealed into opposite ends and contains a fill material that may include mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud that comprises a generally tubular, light-transmissive member, such as quartz, that is able to withstand high operating temperatures. The arc tube and the shroud are coaxially mounted within the lamp envelope with the arc tube located within the shroud. Preferably, the shroud is a tube that is open at both ends.

In those lamps using an arc tube made from quartz or fused silica or like material, the arc tube has a generally tubular body sealed at the ends by a pinch seal. The pinch seals provide a flattened area on the arc tube that lends itself to receiving a mounting structure that both positions the arc tube within the shroud or shield and allows the entire structure to be mounted upon a suitable frame within an envelope.

The shroud or shield has several beneficial effects on lamp operation. In lamps with a gas-filled outer envelope, the shroud reduce convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

In lamps using ceramic arc tubes, mounting the arc tube within a shroud has proven difficult and expensive. The ceramic arc tube has a tubular, often bulbous body with ceramic, cylindrical capillaries extending therefrom. The capillaries are relatively small, often having diameters of 3 mm or so, and contain the electrodes.

DISCLOSURE OF INVENTION

It is, therefore, an object of the invention to obviate the disadvantages of the prior art.

It is another object of the invention to enhance the mounting of arc tubes within shrouds.

It is yet another object of the invention to achieve these objects in an inexpensive manner.

These objects are accomplished, in one aspect of the invention, by the provision of a spring clip that comprises a base that extends in a first plane and has an aperture centrally located therein. Upstanding walls, one at each end of the base, are provided. A first lip extends orthogonally away from one of the walls in a second plane and a second lip extends orthogonally away from the other wall in the second plane. The second plane is substantially parallel to the first plane. Flags formed respectively with the lips extend away from the lips in a plane transverse to the first and second planes.

The clips are used to form an assembly for a lamp. The assembly comprises a light source that has a center with projecting, opposite ends arrayed along a longitudinal axis. The ends are cylindrical in cross-section.

A tubular shroud surrounds the light source and is coaxial with the longitudinal axis. The shroud has two ends.

A pair of spring clips is provided, one at each end of the shroud. Each of the spring clips comprises a base in a first plane and has an aperture centrally located therein. Each aperture of one of the spring clips frictionally engages one of the cylindrical ends of the light source. Upstanding walls are provided, one at each end of the base of the clips, the walls lying adjacent to the interior surface of the shroud and at least a part of each of the walls frictionally engages the interior surface of the shroud.

A first lip extends orthogonally away from a first of the walls in a second plane and a second lip extends orthogonally away from the other of the walls, also in the second plane. The second plane is substantially parallel to the first plane. The lips of each of the clips engage an end of the shroud. Flags formed with the lips extend away from the lips in a plane transverse to the first and second planes.

When the assembly is put into a lamp at least some of the flags are affixed to a frame.

The clips thus provided are economical to manufacture and easy to use. The clips are elastic and, in one embodiment, can be attached to both ends of the arc tube and compressed to allow one of the clips to be passed into the shroud where it elastically unfolds at the required insertion distance.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
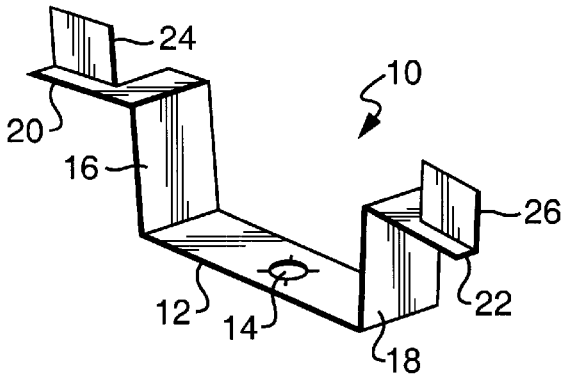
FIG. 1 is a perspective view of a clip of the invention.

Referring now to the drawings with greater particularity, there is shown in FIG. 1 a spring clip 10 comprising a base 12 extending in a first plane and having an aperture 14 centrally located therein. Aperture 14 is substantially circular and is provided with cutouts 14*a* to provide flexibility. Upstanding walls 16, 18, are provide, one at each end of the base 12.

A first lip 20 extends orthogonally away from the wall 16 in a second plane and a second lip 22 extends orthogonally away from the wall 18, also in the second plane. The second plane is substantially parallel to the first plane but spaced therefrom. Flags 24, 26 are formed, respectively with the lips 20, 22, the flags extending away from the lips in a plane transverse to the first and second planes.

Figure 2:
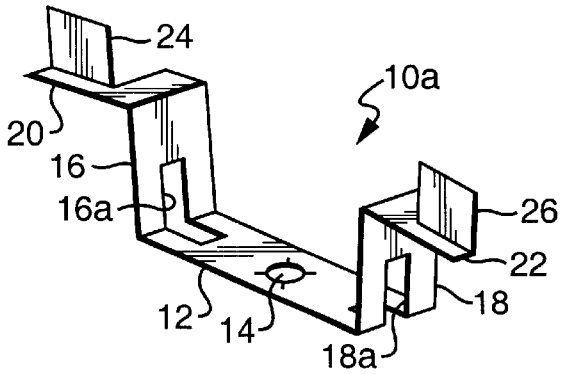
FIG. 2 is a view of an alternate clip.

An alternate embodiment of clip 10 is shown in FIG. 2. Therein a clip 10*a* has slots 16*a* and 18*a* formed in the walls 16 and 18 and extending into the base 12 to aid in the elasticity of the walls.

Figure 3:
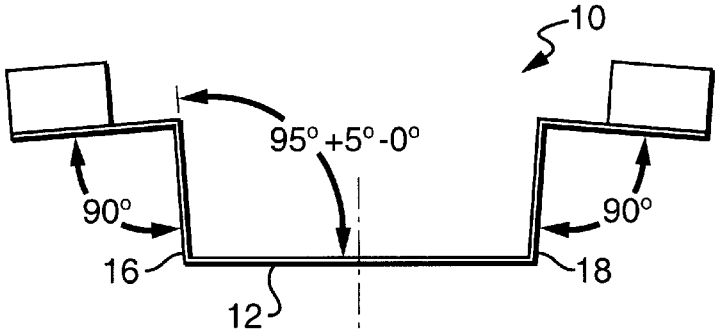
FIG. 3 is an elevational view of a clip of the invention.

In either embodiment of clip 10 or 10*a* the walls 16 and 18 and the flags 20 and 22 form a 90° angle, as shown in FIG. 3, while the angle between the walls 16 and 18 and the base 12 is greater than 90° and preferably is between 95 and 100°. The increased angle assures a good frictional fit within a shroud as will be seen hereinafter.

Figure 4:
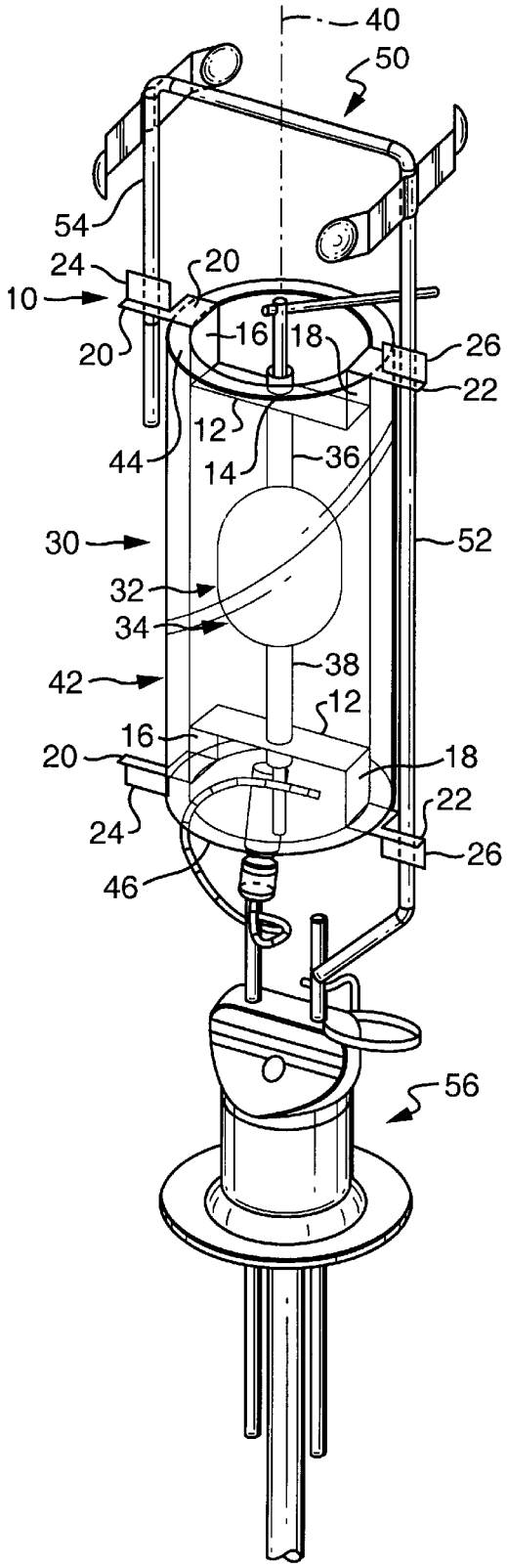
FIG. 4 is a perspective view of an assembly utilizing the clips attached to the frame of a lamp.

Referring now to FIG. 4, there is shown an assembly 30 for a lamp comprising a light source 32 having a center section 34 and projecting, opposite, ends 36, 38 arrayed along a longitudinal axis 40. The ends are cylindrical in cross-section. In a preferred embodiment of the invention the light source 32 is an arc tube formed of a metal oxide such as sapphire or polycrystalline alumina ($Al_2O_3$). Additionally, a metal nitride such as aluminum nitride (AIN) or a metal oxy-nitride such as aluminum oxynitride (AION) can be employed. Other light sources, such as tungsten halogen capsules constructed from quartz or other suitable hard glass may also be used.

A tubular shroud 42 surrounds the light source 32 and is coaxial with the longitudinal axis 40. The shroud has two ends 44, 46.

A pair of spring clips 10 or 10*a* is provided, one at each end 44, 46 of the shroud 40, to support the light source 32 within the shroud.

To assemble the light source in the shroud, the clips 10 or 10*a* are positioned on the cylindrical ends 36 and 38 of the light source by fitting the ends 36, 38 through an aperture 14 and positioning the clips at an appropriate distance along the length of the ends. One of the clips 10 or 10*a* is then manually compressed by bending the lips 20 and 22 inwardly toward each other until the distance between them is smaller than the internal diameter of the shroud being employed. The clip, and its associated light source, is then pushed into the shroud where it will elastically unfold when it reaches the required insertion distance; that is, when the lips 20 and 22 exit the open end, for example, end 44, of the shroud. At the same time, the second, or bottom clip is also in its final position at the end 46 of the shroud.

Alternatively, a clip can be positioned on one end of a capillary at the required distance and a shroud positioned over the light source. The second clip can then be positioned at the other end of the light source. Preferably, a fastening aid or jig is used to maintain proper alignment and positioning.

This action completes the assembly 30, which can now be attached to a suitable frame 50, as is shown in FIG. 4. The frame 50 can comprise wire portions 52 and 54 to which the flags 24, 26 are attached, as by welding or other suitable technique.

The frame 50 can be attached to flare 56, as is known.

There is thus provided a mounting clip and assembly for a light source and shroud that is economical and easy to assemble. The clips are preferably made from stainless steel having a thickness of 0.010 inches. The elasticity of the clips will accommodate quite wide variations in the internal dimensions of the shroud, further reducing costs, by allowing the use of shrouds with wider tolerances.

Assembly costs are also greatly reduced.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An assembly for a lamp comprising:

a light source having a center and projecting, opposite, ends arrayed along a longitudinal axis, said ends being cylindrical in cross-section;

a tubular shroud surrounding said light source coaxial with said longitudinal axis, said shroud having two ends, the improvement comprising;

a pair of spring clips, one at each end of said shroud, each of said spring clips comprising a base in a first plane and having an aperture centrally located therein, each aperture of one of said spring clips frictionally engaging one of said cylindrical ends of said light source upstanding walls, one at each end of said base, said walls lying adjacent to the interior surface of said shroud and at least a part of each of said walls frictionally engaging said interior surface;

a first lip extending orthogonally away from said wall in a second plane;

a second lip extending orthogonally away from said wall in said second plane, said second plane being substantially parallel to said first plane, said lips engaging an end of said shroud: and flags formed, respectively with said lips, said flags extending away from said lips in a plane transverse to said first and second planes.

* * * * *